United States Patent [19]

Hesting

[11] 4,411,591

[45] Oct. 25, 1983

[54] PADDLE WHEEL TURBINE DEVICE

[76] Inventor: Daniel O. Hesting, R.R. 2 - Tulakes, Chanute, Kans. 66720

[21] Appl. No.: 273,748

[22] Filed: Jun. 15, 1981

[51] Int. Cl.[3] ..... F01D 5/06

[52] U.S. Cl. ..... 415/103; 415/203; 416/196 R

[58] Field of Search ..... 415/90, 92, 98, 99, 415/101, 103, 202, 203; 416/199, 195, 196

[56] References Cited

U.S. PATENT DOCUMENTS

| | | | |
|---|---|---|---|
| 658,969 | 10/1900 | Walter | 416/199 |
| 1,255,663 | 2/1918 | Swanson | 415/203 |
| 1,352,588 | 9/1920 | Egedi | 415/202 |
| 2,190,245 | 2/1940 | Sartell | 415/98 |
| 3,140,986 | 7/1964 | Hubbard | 202/52 |
| 3,755,076 | 8/1973 | Lindsley | 176/39 |
| 4,069,673 | 1/1978 | Lapeyre | 60/641 |
| 4,104,535 | 8/1978 | Bronicki | 290/52 |

*Primary Examiner*—Philip R. Coe
*Assistant Examiner*—Thomas W. Epting
*Attorney, Agent, or Firm*—D. A. N. Chase; Michael Yakimo, Jr.

[57] ABSTRACT

A power turbine employs a plurality of turbine blades each having a normal lip mounted at the free ends thereof. The plurality of turbine blades are mounted in a paddle wheel type configuration about the turbine power shaft. The paddle wheel blade configuration is interposed between the pressurized fluid inlet and outlet ports for efficient response to the pressurized fluid moving therebetween. Directional fans mounted about the rotating shaft maintain the fluid flow through the turbine so as to assure an optimum power as offered by the rotating turbine shaft. A home power generation system utilizing the turbine is also disclosed herein.

13 Claims, 4 Drawing Figures

PADDLE WHEEL TURBINE DEVICE

BACKGROUND OF THE INVENTION

This invention relates to a steam turbine and more particularly to a steam turbine employing an array of particularly-shaped turbine blades mounted in a paddle wheel type configuration about a turbine drive shaft.

Turbine engines are known in the art and provide for the operation of electrical energy or production of mechanical work for transfer to associated apparatus. Steam turbines employ the energy of a flowing fluid stream for conversion into mechanical energy. In operation of turbines it is important that the working fluid flow steadily through the turbine and that the transfer of heat through the turbine housing is negligible. The power developed for unit mass flow of fluid corresponds to the measurable difference of components in a fluid property called specific stagnation enthalpy. This fluid property comprises essentially two parts. Enthalpy is a thermal dynamic property which in steam is a function of pressure and temperature. The second part is the kinetic energy due to motion of the fluid through the turbine. Thus, it can be appreciated that the maintenance of a fluid flow through the turbine is of importance.

Steam turbines are still in various states of evolution. In modern use the density of the steam at turbine entry, especially in multistage turbines, can be significantly greater than that at the exit. To provide responsive blades to such difference and to keep the blade heights of the turbine within practical bounds, it is desirable to divide the fluid flow. Thus, the turbine has been divided into multistage compartments including a high pressure compartment which transmits some of the steam back to the boiler for reheating, an intermediate pressure compartment and, if desired, a low pressure compartment. All compartments have turbine blades therein attached to the turbine shaft. Thus, it is of importance to have an effective blade response to this expanding steam as well as efficient fluid movement from one pressure compartment of the turbine to the other.

Accordingly, I have invented a steam turbine that utilizes a series of particularly-shaped turbine blades forming a paddle wheel turbine blade array about which the turbine shaft which effectively responds to the steam fluid flow. In a multistage turbine I employ means for efficiently transferring the steam from one compartment of the turbine to another to insure a continuous fluid flow. The turbine blades, particularly those in the high-pressure stage, have been reinforced by concentric expansion tubes passing therethrough so as to reinforce the turbine blades during periods of high temperature and fast rotation.

Furthermore, the efficient turbine can be utilized for operation in various power generation systems, one of which is herein enclosed.

Accordingly, it is a general object of this invention to provide an efficient fluid driven turbine capable of effective operation and use.

Another object of this invention is to provide a turbine, as aforesaid, having a plurality of particularly shaped blades mounted about the turbine shaft in a manner to present a paddle wheel configuration to the turbine blade array.

Another object of this invention is to provide a turbine having a paddle wheel turbine blade array interposed in the fluid flow path for an effective paddle wheel response to the expanding pressurized fluid.

A more particular object of this invention is to provide a turbine, as aforesaid, having points of fluid entry and exit in an apex/nadir relationship with said paddle wheel array interposed therebetween.

Still another particular object of this invention is to provide a turbine blade having a normally disposed lip at the free edge thereof to aid in said effective response to and directional control of the pressurized fluid.

A still further object of this invention is to provide a turbine, as aforesaid, of the multistage type having means therein to assure a consistent flow of the working fluid throughout the turbine apparatus.

Still another object of this invention is to provide a power generation system utilizing said turbine, as aforesaid, and designed for efficient small scale operation and use.

Other objects and advantages of this invention will become apparent from the following description taken in connection with the accompanying drawings, wherein is set forth by way of illustration and example, an embodiment of this invention.

DESCRIPTION OF THE PREFERRED EMBODIMENT

Figure 1:
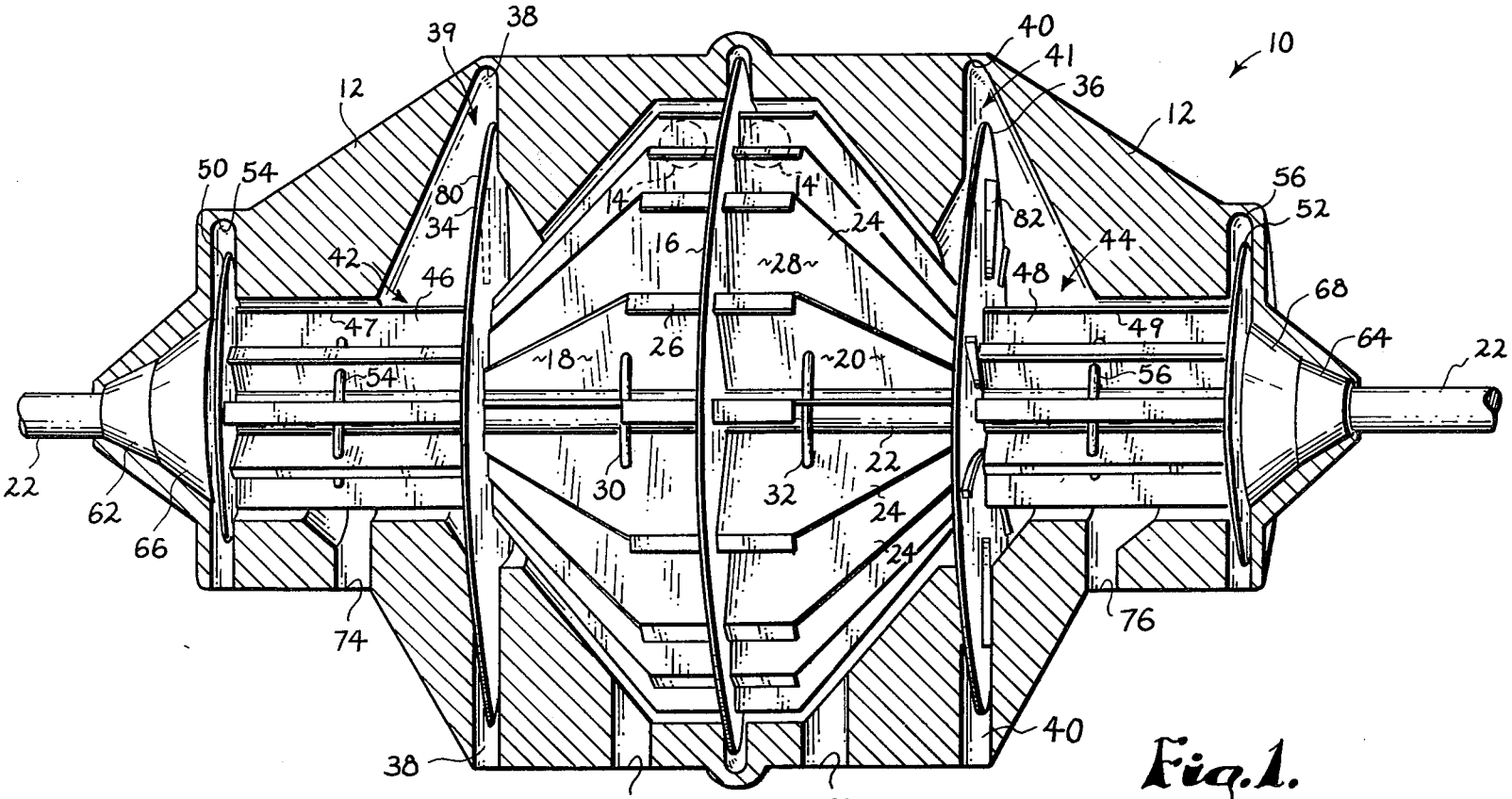
FIG. 1 is an elevation view of a multistage turbine, the housing being sectioned to show the paddle wheel blade array and directional fans therein.

Referring more particularly to the drawings, FIG. 1 shows a turbine 10 of the multistage type. The turbine housing 12 has, as shown in FIG. 1, been selectively sectioned allowing a view of the interior components in whole as to be subsequently explained.

Associated with the turbine 10 is a high pressure steam generator (not shown), such pressurized steam entering the turbine 10 through inlet ports 14 and 14' in the turbine housing 12. These inlet ports 14 and 14' have been laterally spaced apart to lie on opposite sides of a divider disc 16. The divider disc 16 consists of a planar disc extending across the interior of the turbine housing 12 and provides equalization and directional control of the entering and exiting pressurized fluid injected therein. The divider disc 16 is mounted to the torque or power shaft 22 for concurrent rotation therewith and presents a common wall to a pair of juxtaposed primary stage compartments 18 and 20.

Attached to the torque shaft 22 are a plurality of primary turbine blades 24 spaced about the periphery or circumference of this shaft 22 so as to present a paddle wheel configuration. Each of the blades 24 has a planar fluid responsive surface 28 with a lip 26 positioned at the outer end of surface 28 in a normal relationship thereto.

Passing through each of the primary blades 24 are annular expansion tubes 30 and 32 concentric with the shaft 22. The tubes 30 and 32 are made of a metal having a tendency to expand faster than that of the metal of the primary blades 24. Accordingly, during use, these tubes 30 and 32 will expand at a greater rate so as to provide a desired and necessary reinforcement to the heated and rotating blades. This reinforcement enables the blades 24 to be made of a relatively light weight metal while maintaining a desired strength characteristic.

Laterally spaced apart from the opposed surfaces of the divider disc 16 are first and second directional fans 34 and 36 having a plurality of directional vanes 80 and 82 on the respective outboard surfaces thereof. These directional fans 34 and 36 are mounted to the shaft 22 and present the outside walls of the respective primary compartments 18 and 20. Each fan extends into an annular directional channel 38 and 40. These channels 38 and 40 provide a passageway for the expanding pressurized steamed fluid from the primary compartments 18 and 20 into the secondary compartments 42 and 44. As shown, the apex position 39 and 41 of each respective channel 38 and 40 are greater in area allowing for a positive entry of the steam from the adjoining primary compartments 18 and 20. Furthermore, this apex relationship allows the steam to enter the secondary compartments 42 and 44 at a zenith relationship relative to the paddle wheel array of secondary turbine blades 46 and 48 located therein. The directional vanes 80 and 82 on the outboard surface of each fan 34 and 36 aid in a positive flow of the expanding fluid from the primary compartments 18 and 20 into the secondary compartments 42 and 44.

Torque shaft 22 extends through the secondary compartment 42 and 44 and beyond the turbine housing 12. Located at the ends of the torque shaft 22 within the housing 12 are high speed bearings 62 and 64 with seals 66 and 68.

A plurality of peripherally spaced-apart secondary turbine blades 46 and 48 are mounted about the portion of the torque shaft 22 extending through the secondary compartments 42 and 44. These secondary turbine blades 46 and 48, having lips 47 and 49, are mounted in a manner as the above-described primary blades 24 to present a secondary paddle wheel blade array in each respective compartment 42 and 44. Terminal divider discs 50 and 52 are laterally spaced-apart from each directional fan 34 and 36 to define the outside walls of the respective secondary compartments 42 and 44. The respective terminal discs 50 and 52 extend into annular channels 54 and 56 with an exhaust port in communication with these channels. Annular expansion tubes 54 and 56 extend through the secondary collector blades 46 and 48 and function in a like manner as the primary expansion tubes 30 and 32.

Exhaust ports 70, 72, 74 and 76 are in communication with each of the primary 18, 20 and secondary 42, 44 compartments for discharge of the pressurized fluid therefrom. It is preferred that the respective exhaust ports be in a nadir relationship relative to the inlet ports 14 and 14' and points of entry of incoming steam into the respective compartments with the respective paddle wheel blade array interposed therebetween. The configuration of each individual turbine blade, the blade arrangement in a paddle wheel type configuration and the interposition of each paddle wheel blade array in the fluid flow path extending between the zenith points of entry and nadir points of discharge of the pressurized steam provides an effective paddle wheel response to the expanding pressurized fluid. This response powers the shaft 22 as well as provides for the important maintenance of a continuous fluid flow. The lips 26, 47, 49 on each respective blade 24, 46, 48 have been deemed to be effective in the response to the expanding pressurized fluid as well as for moving the spent fluid through its flow path. This fluid flow is further aided by the directional fans 34 and 36 to assure passage of the pressurized fluid from the primary to secondary compartments as above described.

Accordingly, the paddle wheel configuration of the turbine 10 is effective in providing rotation to the shaft 22 for efficient production of mechanical work or electrical power corresponding to the power generation devices associated therewith.

Figure 2:
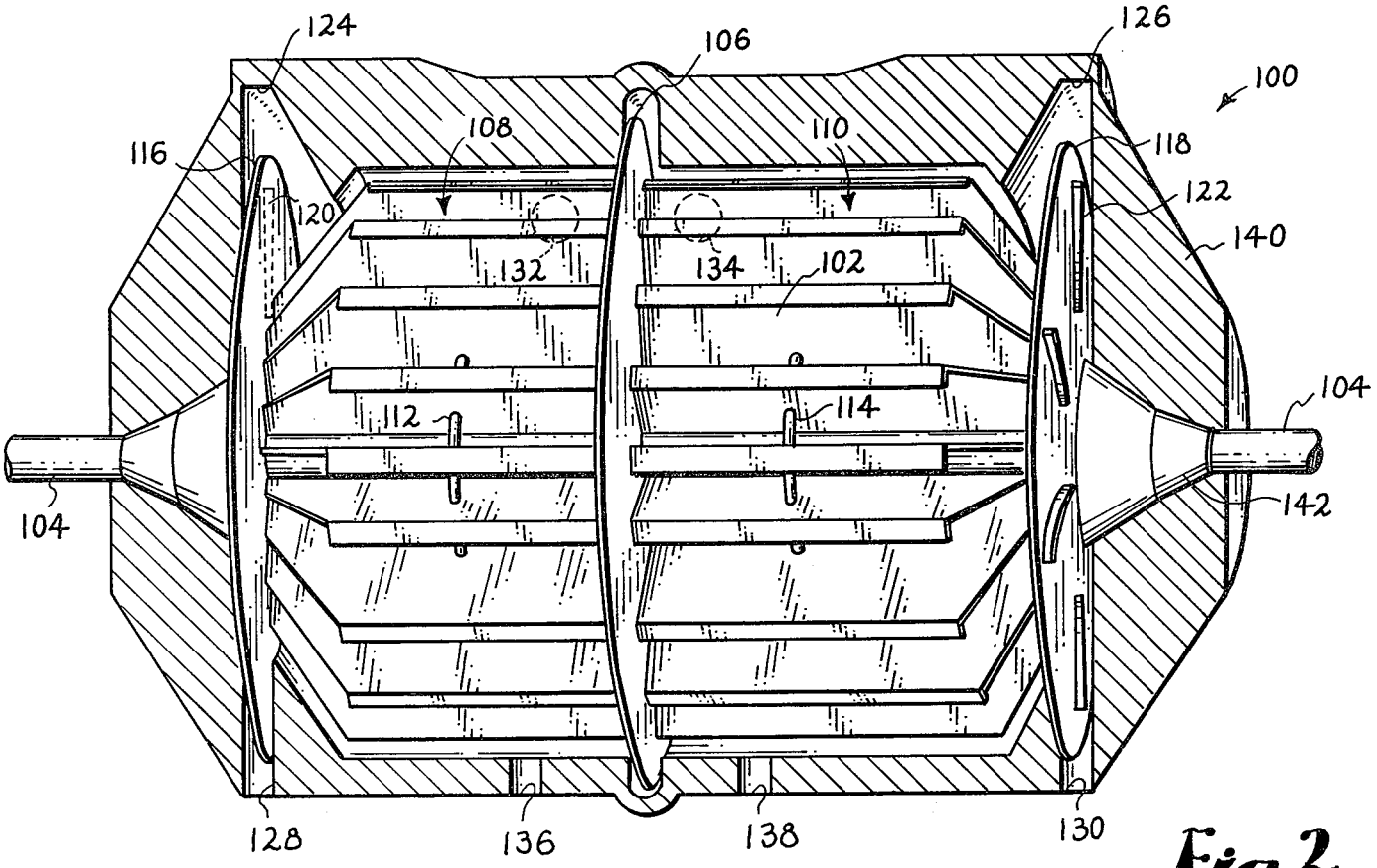
FIG. 2 is a sectional elevation view of a single stage turbine, the housing being sectioned to show the paddle wheel blade array and directional fans therein.

FIG. 2 sets forth a single stage turbine 100 employing a paddle wheel array comprising a plurality of turbine blades 102, as above-described, mounted about the turbine drive shaft 104 in a manner to present a paddle wheel blade array. The ends of the turbine shaft 104 pass through the turbine housing 140 and are encompassed therein by sealed bearings 142 or the like. A divider disc 106 mounted to shaft 104 is employed to present first and second juxtaposed turbine compartments 108 and 110. Annular expansion tubes 112 and 114 extend through each blade 102 and function as those tubes above-described.

The outboard limits of each compartment 108 and 110 are established by directional fans 116 and 118. Each fan has a plurality of vanes 120 and 122 on the outboard side thereof to aid the fluid flow through the surrounding annular channels 124 and 126 and out the secondary exhaust ports 128 and 130 in communication with channels 124 and 126.

Located in the compartments 108 and 110 are laterally spaced-apart inlet ports 132, 134 and primary exhaust ports 136, 138. Inlet ports 132, 134 are positioned near the apex of the paddle wheel array with the primary exhaust ports 136, 138 being positioned at the nadir thereof. Accordingly, the paddle wheel array is interposed between these inlet and outlet ports in the fluid flow path so as to be effective in driving the paddle wheel array and the turbine shaft 104 connected in a manner as above-described with the same accompanying advantages and results.

Figures 3, 4:
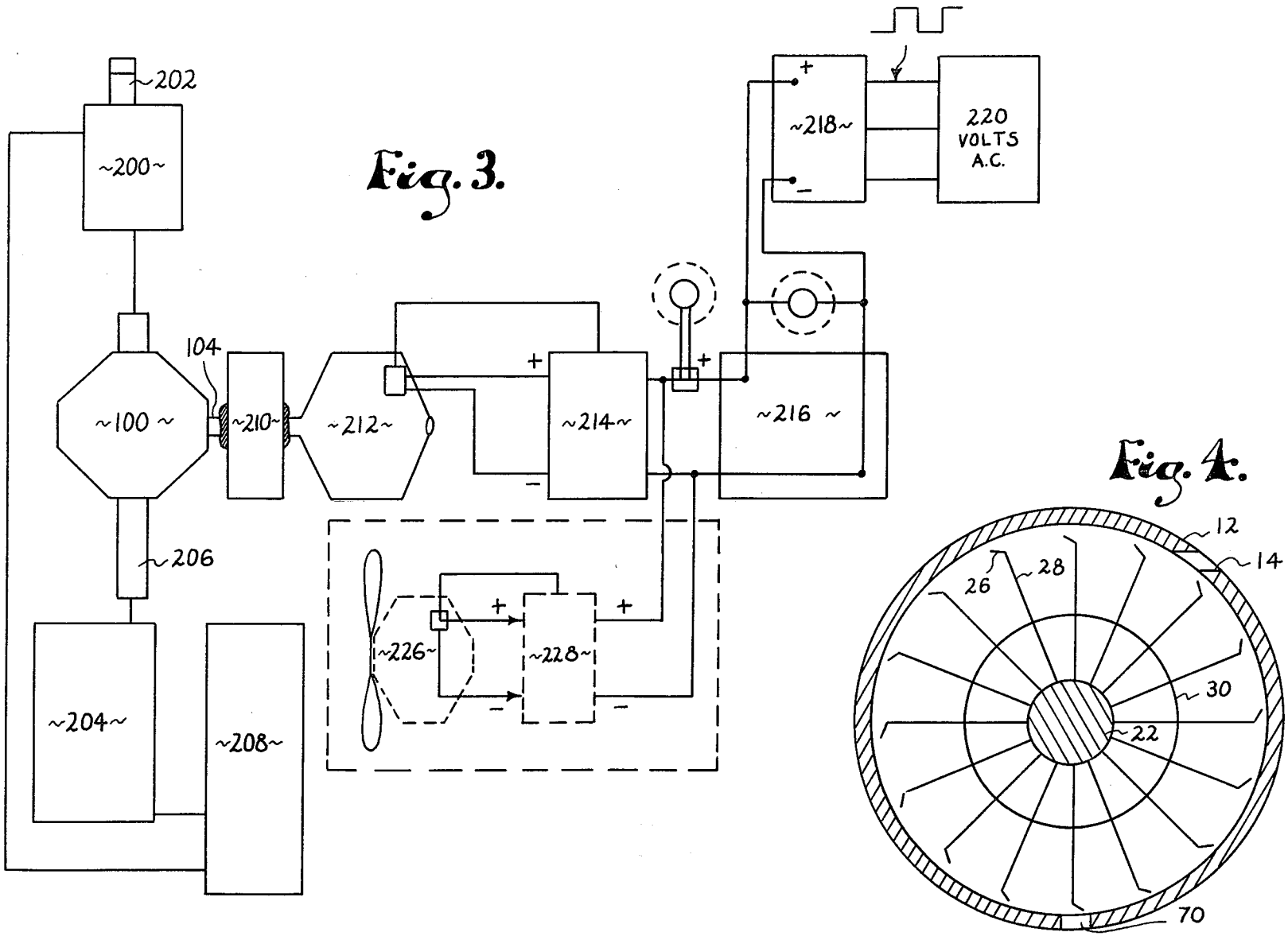
FIG. 3 is a diagrammatic view setting forth a small scale power generation system utilizing the turbine of FIG. 2.
FIG. 4 is a diagrammatic view showing the apex/-nadir relationship of the fluid input and output ports and the interposition of the paddle wheel blade array therebetween.

Referring more particularly to the power generation system as diagrammatically shown in FIG. 3, the pressurized steam is generated in boiler 200 for injection into the single stage turbine 100 through inlet ports 132 and 134. The boiler 200 is equipped with a filter 202 thereon preventing escape of the noxious contaminants resulting from the boiling process. After discharge from the turbine 100 the steam upon exit through the turbine exhaust ports is channeled via line 206 to condensor 204 for return to a liquid $H_2O$ state. The liquid is routed to a small storage tank 208 for return to the boiler 200.

Work produced by the pressurized steam passing through the turbine 100 drives the torque shaft 104 therein so as to power through the reduction gear means 210 the generator 212. A voltage regulator 214 provides a 75 volt DC charge for storage in a home battery pack 216. Voltage from the battery pack 216 is then passed through a square wave inverter 218 which provides power through inversion 220 volts AC for normal home use.

Additionally, the battery pack 216 of the system can be provided a supplemental energy charge by the use of a wind generator 226 producing a current passing through voltage regulator 228 so as to also charge the battery pack 216.

It is understood that the system as above-described is designed for a small scale use and as such can efficiently and effectively meet the normal power demands of a home for two days of continuous use and three days of use during a normal load requirement. It is also understood that the use of the paddle wheel turbine 100 as above-described adds to the effectiveness of this system.

It is to be understood that while certain forms of this invention have been illustrated and described, it is not limited thereto, except in so far as such limitations are included in the following claims.

Having thus described the invention, what is claimed as new and desired to be secured by Letters Patent is:

1. In a turbine having a power shaft for operating apparatus connected thereto, the improvement being means for rotating said shaft comprising:

a plurality of turbine blades mounted about said power shaft in a peripherally spaced-apart relationship and presenting a paddle wheel configuration to said blade array;

at least one inlet port for directing a pressurized fluid into said turbine;

at least one exhaust port for discharging said fluid from said turbine, said inlet port and said exhaust port defining a fluid flow path and positioned in an apex/nadir relationship relative to said paddle wheel blade array for interposition of said blade array in said fluid flow path in a rotating response thereto, whereby to drive said power shaft;

said turbine blades further comprising:

a generally planar surface extending from said shaft, said surface having an edge radially displaced from the axis of said shaft;

a flanged surface normally extending from said edge and in the direction of said rotation, said planar surface responding to said fluid flow with said rotating movement and cooperating with said flanged surface to maintain movement of said fluid between said inlet and exhaust ports; and at least one continuous rod passing through each of said blades, said rod made of a material having a greater rate of expansion than said blade material with said relative rate of expansion providing for reinforcement of said blades by said rod during said rotating response.

2. In a multistage fluid turbine having at least one high pressure compartment and a juxtaposed relatively lower pressure compartment with a drive shaft passing therethrough, means for providing movement of said fluid from said high pressure compartment to said lower pressure compartment comprising:

a directional fan having a disc-like surface mounted to the drive shaft of said turbine, said disc surface providing a common wall between said juxtaposed compartments;

channel means in said turbine surrounding the periphery of said disc for providing communication of said fluid between said compartments; and a plurality of vanes on said disc and projecting into said lower pressure compartment, said disc surface rotating with said turbine shaft with said vanes drawing said fluid through said channel means whereby to provide for said fluid movement.

3. A multistage turbine comprising:

a housing presenting a cavity therein;

a divider disc passing through said cavity;

first and second disc-like members laterally spaced from said divider disc on the opposed sides thereof, said members cooperating with said divider disc to present first and second high pressure compartments in said turbine;

first and second terminal discs laterally spaced from said respective first and second disc-like members to present a pair of relatively lower pressure compartments in a juxtaposed relationship with said first and second high pressure compartments;

a power shaft extending through said housing and through each of said compartments;

inlet means for injecting a pressurized fluid into said first and second high pressure compartments;

channel means about the periphery of each disc-like member for communicating said respective high pressure compartment to said adjacent low pressure compartment;

exhaust means in communication with said compartments for discharging said pressurized fluid from said compartments; and a plurality of turbine blades in each of said compartment and mounted about said power shaft in a peripherally-spaced relationship, said plurality of blades in each compartment presenting a respective paddle wheel blade array to said injected fluid whereby said expanding fluid acts against said respective paddle wheel array and rotates said shaft.

4. The device as claimed in claim 3, wherein said inlet means and said exhaust means are positioned in an apex/nadir relationship relative to said respective paddle wheel array in said respective high pressure compartment for interposition of said respective blade array in the fluid flow path, whereby to maintain said fluid flow between said compartments.

5. The device as claimed in claim 3, wherein each of said turbine blades comprises:

a generally planar surface extending from said shaft, said surface having an edge radially displaced from the axis of said shaft; and a flange surface normally extending from said edge and in a direction of said rotation, said planar surface responding to said fluid with said rotating movement and cooperating with said flange surface to maintain movement of said fluid between said inlet means and said exhaust means.

6. The device as claimed in claim 3, further comprising:

at least one continuous rod passing through each of said blades, said rod made of a material having a greater rate of expansion than said blade material with said relative rate of expansion providing for reinforcement of said blades by said rod during said rotating response.

7. The device as claimed in claim 3, further comprising:

a plurality of vanes on said first and second disc-like members and projecting into said lower pressure compartment, said disc surface rotating with said turbine shaft with said vanes drawing said fluid through said respective channel means whereby to assist in said fluid movement between said compartments.

8. A single stage turbine comprising:

a housing presenting a cavity therein;

a divider disc passing through said cavity;

first and second disc-like members laterally spaced from said divider disc on the opposed sides thereof; said members cooperating with said divider disc to present first and second high pressure compartments in said turbine;

a power shaft extending through said housing and through each of said compartments;

inlet means for injecting a pressurized fluid into said first and second high pressure compartments;

channel means about the periphery of each disc-like member for communication of said fluid from said respective high pressure compartment;

an exhaust port in communication with said respective channel means for discharge of said fluid therefrom;

primary exhaust means in communication with said compartments for discharging said pressurized fluid from said compartments; and a plurality of turbine blades in each of said compartments and mounted about said power shaft in a peripherally-spaced relationship, said plurality of blades in each compartment presenting a respective paddle wheel blade array to said injected fluid whereby said expanding fluid acts against said respective paddle wheel array and rotates said shaft.

9. The device as claimed in claim 8, wherein said inlet means and said primary exhaust means are positioned in an apex/nadir relationship relative to said respective paddle wheel array for interposition of said respective blade array in the fluid flow path, whereby to maintain said fluid flow.

10. The device as claimed in claim 8, wherein each of said turbine blades comprises:

a generally planar surface extending from said shaft, said surface having an edge radially displaced from the axis of said shaft; and a flange surface normally extending from said edge and in a direction of said rotation, said planar surface responding to said fluid with said rotating movement and cooperating with said flange surface to maintain movement of said fluid between said inlet means and said primary exhaust means.

11. The device as claimed in claim 8, further comprising:

at least one continuous rod passing through each of said blades, said rod made of a material having a greater rate of expansion than said blade material with said relative rate of expansion providing for reinforcement of said blades by said rod during said rotating response.

12. The device as claimed in claim 8, further comprising:

a plurality of vanes positioned on said first and second disc-like members on the outboard side thereof, said first and second members rotating with said turbine shaft with said vanes drawing said fluid through said respective channel means whereby to assist in said fluid movement.

13. In a turbine having a power shaft for operating apparatus connected thereto, the improvement being means for rotating said shaft comprising:

a plurality of turbine blades mounted about said power shaft in a peripherally spaced-apart relationship and presenting a paddle wheel configuration to said blade array;

at least one inlet port for directing a pressurized fluid into said turbine;

at least one exhaust port for discharging said fluid from said turbine, said inlet port and said exhaust port defining a fluid flow path and positioned in an apex/nadir relationship relative to said paddle wheel blade array for interposition of said blade array in said fluid flow path in a rotating response thereto, whereby to drive said power shaft; and at least one continuous rod passing through each of said blades, said rod made of a material having a greater rate of expansion than said blade material with said relative rate of expansion providing for reinforcement of said blades by said rod during said rotating response.

* * * * *